US005245904A

United States Patent [19]

Meyerle

[11] Patent Number: 5,245,904

[45] Date of Patent: Sep. 21, 1993

[54] NON-SKID BALL BEARINGS WITH ADJUSTABLE STROKE FOR PUNCH PRESSES

[76] Inventor: George M. Meyerle, 17 Lakeview Dr., Brookfield, Conn. 06804

[21] Appl. No.: 872,882

[22] Filed: Apr. 23, 1992

Related U.S. Application Data

[62] Division of Ser. No. 544,123, Jun. 26, 1990, Pat. No. 5,113,736.

[51] Int. Cl.[5] ..... B26D 5/08

[52] U.S. Cl. ..... 83/529; 83/530; 83/575; 83/637; 72/430; 100/257; 384/30; 384/49

[58] Field of Search ..... 83/529, 530, 575, 576, 83/577, 637; 72/430, 707, 54; 100/257, 917; 384/30, 49

[56] References Cited

U.S. PATENT DOCUMENTS 3,029,110 4/1962 Hughes ..... 384/30
3,450,037 6/1969 Lickliter et al. ..... 83/529 X
3,514,166 5/1970 Coley ..... 384/49
3,709,083 1/1973 Doherty ..... 83/575
4,022,090 5/1977 Doherty et al. ..... 83/637 X
4,056,029 11/1977 Doherty et al. ..... 83/575
4,135,770 1/1979 Doherty et al. ..... 384/30

FOREIGN PATENT DOCUMENTS 63-76910 4/1988 Japan .

*Primary Examiner*—Eugenia Jones
*Attorney, Agent, or Firm*—Parmelee, Bollinger & Bramblett

[57] ABSTRACT

An electromagnetically-driven punch press having adjustable anti-skid supports for the ball bearings and ball cages of the ball-bearing bushings which carry the movable tool for preventing downward skidding of these balls and their cages when the moving tool punches down against the work material. Adjustable resilient cushioning arrests tool travel for minimizing "tool whip" and tool wear at the end of the work stroke.

19 Claims, 8 Drawing Sheets

| ARMATURE SPACER CHART | | |
|---|---|---|
| STROKE SETTING | SPACERS NEEDED | |
| | 0.125 | 0.250 | 0.375 |
| 1.38 TO 1.50 | | | |
| 1.26 TO 1.37 | ■ | | |
| 1.01 TO 1.25 | | ■ | |
| 0.76 TO 1.00 | | | ■ |
| 0.51 TO 0.75 | ■ | | ■ |
| 0.26 TO 0.50 | | ■ | ■ |
| 0.00 TO 0.25 | ■ | ■ | ■ |

NON-SKID BALL BEARINGS WITH ADJUSTABLE STROKE FOR PUNCH PRESSES

RELATED APPLICATION

The present application is a Divisional of my prior copending application Ser. No. 07/544,123, filed Jun. 26, 1990, and issued as U.S. Pat. No. 5,113,736 on May 19, 1992.

FIELD OF THE INVENTION

The present invention is in the field of electromagnetically driven punch presses, and more particularly relates to such impact presses having adjustable anti-skid supports for their ball-bearing bushings.

BACKGROUND

As background for the present invention, reference is invited to four Doherty U.S. Pat. Nos. 3,709,083; 4,022,090; 4,056,090; and 4,135,770, copies of which are being furnished herewith for convenience of examination.

In the punch press shown in Doherty—U.S. Pat. No. 3,709,083, the tooling is in a fringe flux path of the solenoid winding 82, 84 such that the tooling tends to become magnetized. There is no provision for direct cooling of the electromagnet. There is no provision shown for adjustment of stroke length.

In the punch press disclosed in Doherty—U.S. Pat. No. 4,022,090, the solenoid winding is located in the base of the machine sandwiched between a base plate and a connecting plate causing the winding to be subject to overheating and being without cooling. The base location of the bulky winding interferes with handling of materials, interferes with exit of scrap pieces, makes for inconvenient tooling set-up, and causes difficulty in adjustments of open and shut height and stroke length. In the Doherty punch press shown in the '090 patent, the tooling and guide pins and their bushings are all located in a significant fringe flux path of the solenoid winding causing them all to become magnetized. Such magnetization of tooling, guide pins and bushings causes steel shavings, filings, burr pieces and flakes and similar scraps of steel to become attracted to and to collect on these magnetized parts, leading to their rapid deterioration or actual sudden destruction. When a steel scrap of significant size becomes adhered to one side of a male or female die overlying a cutting edge, subsequent closure of the dies produces a sudden, eccentric, off-axis obstruction deflecting the male die and causing it to smash into an incorrect region of the female die with consequent destruction of the dies. Steel particles adhering to the guide pins become abrasive intrusions wedging between the moving parts and quickly wearing and soon destroying them.

In the punch press described in Doherty—U.S. Pat. No. 4,056,029, the solenoid winding is located in a movable housing which is secured to a movable tool holder. The winding together with its electrical connections moves during each stroke. Thus, the winding and its connections are subjected to a severe beating due to repeated frequent mechanical shocks of tool impact against work material. Such repeated mechanical impact stressing of the winding and its electrical connections tends to cause early electrical failure with relatively short reliable operating life. It is noted that in FIGS. 2 and 4 the moving bushings 26 bottom on stops 86 (col. 5, line 16).

Doherty U.S. Pat. No. 4,135,770 is a Division of U.S. Pat. No. 4,056,029, and is directed to a leader pin for a punch press die set having a bore in the leader pin containing an elongated axially movable button and a spring urging this movable button toward its extended position. This button is pushed inwardly during each power stroke and springs back to its extended position for pushing the movable portion of the die set back to its initial position. This complex leader pin serves as a stationary armature in cooperation with a movable solenoid winding having a movable housing as discussed above regarding the '029 patent.

In the '029 and '770 patents moving non-ball-bearing bushings 26 (FIGS. 2 and 4; often called "sleeve bushings") are shown bottoming on stops 86. During recent years ball-bearing bushings (often called "linear bearings") have been used instead of sleeve bushings in many instances in punch presses for reducing friction during the power and return strokes. The balls in such linear bearings are mounted in a cage (also called a "retainer") within a housing, and it is the housing of the linear bearing which bottoms against such stops. A problem caused by such substitution of linear bearings for sleeve bushings is the consequent downward skidding of the cage and balls, caused by their own downward momentum thereby causing rubbing wear on the guide pin during each downward stroke and return stroke with consequent rapid deterioration of the balls and cage in the linear bearing. In other words, each time the bearing housing bottoms down against the stop, the housing suddenly stops its rapid downward motion, but the cage and balls have significant downward momentum and tend to skid down. During the subsequent upstroke, the misplaced balls cannot roll freely due to the conventional retainer, and so they skid up against the guide pin with consequent undue wear of the guide pin and rapid deterioration of the components in the linear bearing.

SUMMARY

An electromagnetically-driven punch press embodying the present invention has an electromagnetic drive thrust motor comprising a solenoid winding and movable armature in an elevated location above the die set. The solenoid winding is mounted within a fan-cooled ferromagnetic housing secured to the top of a stationary ferromagnetic top plate arranged for isolating the magnetic circuit from the die set and tooling so as to avoid magnetization of the tooling, and isolating electrical heating of the winding from the tooling for stabilizing dimensions of the tooling.

By virtue of their elevated location, the winding and armature are readily accessible for convenient cooling by a fan. Moreover, since the stationary top plate is mounted to the top ends of vertical guide pins and since the electromagnetic drive thrust motor is mounted above this stationary top plate, the motor is stationary and is out of the way, and this arrangement thereby provides for convenient adjustment of: stroke length, "open" height and "shut" height.

In order to prevent downward dislodgement of the cage and balls in the linear bearings (ball-bearing bushings), there are anti-skid supports. Adjustable resilient cushioning arrests tool travel for minimizing "tool whip" and for minimizing tool wear occurring in the prior art near the end of each work stroke due to misalignment caused by such tool whip.

BRIEF DESCRIPTION OF THE DRAWINGS

The various additional features, aspects, advantages and objects of the present invention will become more fully understood from a consideration of the following detailed description of presently preferred embodiments, together with the accompanying drawings, which are not drawn to scale but rather are arranged for clarity of illustration and explanation. In these drawings:

FIG. 7 is an elevational sectional view taken along the line 7—7 in FIG. 4.

FIG. 8 is an elevational sectional view taken along the line 8—8 in FIG. 7.

DETAILED DESCRIPTION OF PREFERRED EMBODIMENTS

Figure 1:
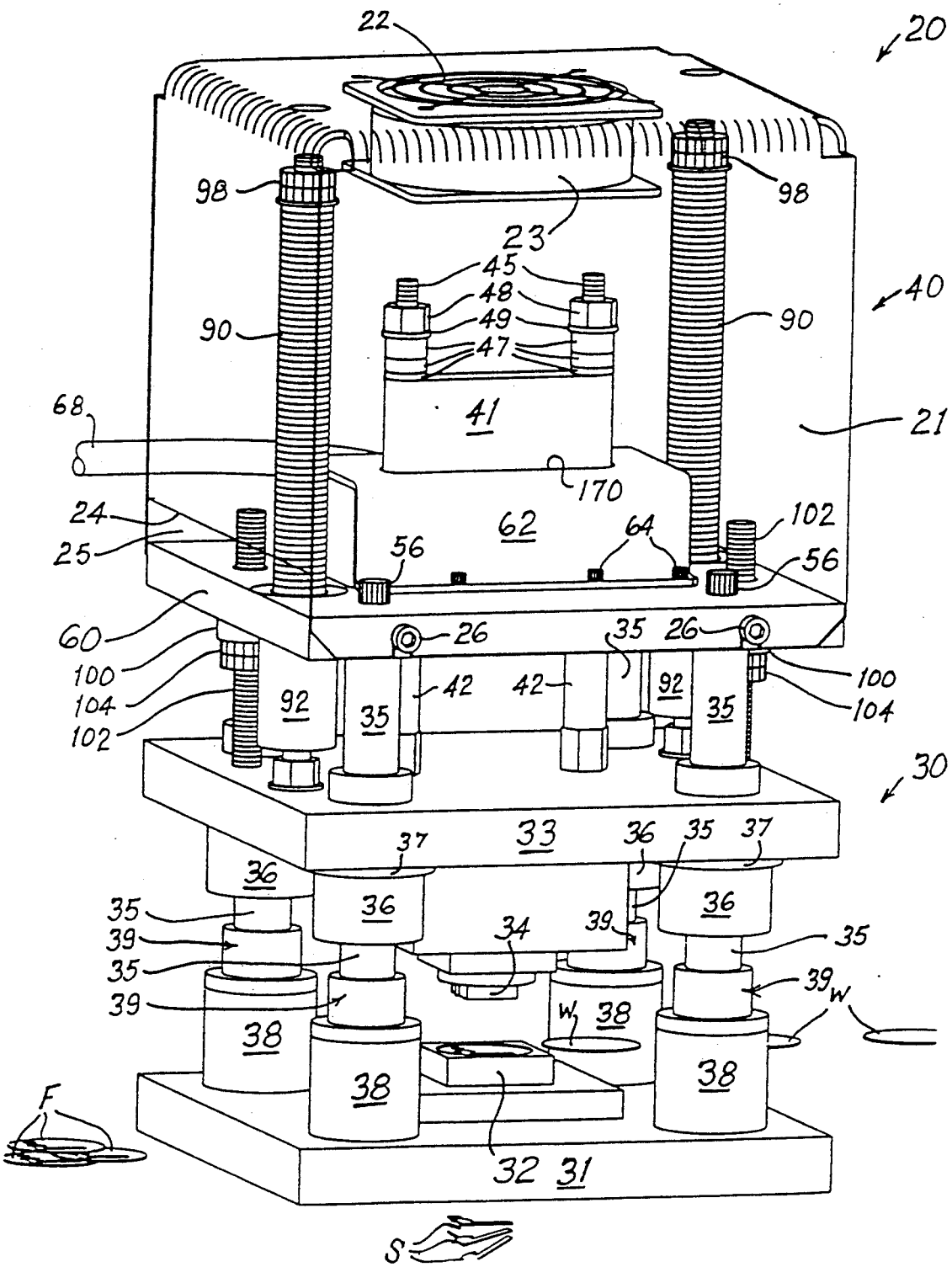
FIG. 1 is a perspective view of a punch press embodying the present invention.

In FIG. 1 is shown a punch press 20 including a die set 30 and an electromagnetic thrust motor 40 for driving the die set in a powerful stroke from an "open" position to a "shut" position. A removable housing 21 of the thrust motor 40 is drawn with a transparent appearance for clarity of illustration. This housing 21 includes an air intake grille 22 having a pancake-type fan 23 mounted below this intake port for blowing cooling air downwardly onto electromagnetic components of the motor 40 to be described later. To provide for exit of the cooling air, sidewalls of the housing 21 terminate at a bottom lip 24 forming outlet ports 25 (only one is seen) at the bottom of this housing. The front and rear walls of this housing are removably attached by cap screws 26 to a stationary top plate or deck 60 to be described in detail later.

The die set 30 comprises a stationary base plate 31 with a female die 32 secured to the base plate and a motion plate 33 carrying a male die 34 aligned with and in opposed relation to the female die 32. Four guide pins (posts) 35 are fixed to and extend vertically from the base plate 31. The motion plate 33 is movably mounted on the four vertical guide pins 35 by respective linear bearings (ball-bearing bushings) 36 which are secured to the motion plate 33 and travel down and up with it. The motion plate 33 seats down upon an annular shoulder 37 which encircles each ball-bearing bushing 36. The motion plate 33, male die 34, and ball bearing bushings 36 comprise the main components of the movable portion of the die set 30.

One of the novel aspects of this die set 30 is that the guide pins or posts 35 are considerably longer than usual. These guide pins extend up through the motion plate 33 to an elevation or level located relatively high above the motion plate for supporting a removable top plate (deck) 60 on which is mounted the electromagnetic thrust motor 40. Thus, the tooling 34, 32 is isolated from the magnetic field of the motor 40 for avoiding magnetization of the tooling. Also, any heating of the thrust motor due to electrical resistance and hysteresis losses is isolated from the tooling for minimizing distortion of the dies resulting from thermal expansion.

Work material "W" can be fed into the die set 30 from front, back, left or right. For example, as shown in FIG. 1, the workpieces W are being fed from the right by suitable work material feed means as known in the art, and such feed means do not comprise part of the present invention and are omitted for clarity of illustration. After each workpiece W has been formed by impact action of the dies 32, 34, resulting scrap pieces "S" are ejected downwardly from the female die 32 through a discharge opening (not shown) in the base plate 31. The finished pieces "F" are fed out toward the left.

In order to stop the downward motion of the movable portion of the die set at the downward limit of its work stroke, there are resilient stops 38 which are adjustable in height, as will be explained later. The housings of the ball-bearing bushings 36 abut against these stops 38.

Figure 6B:
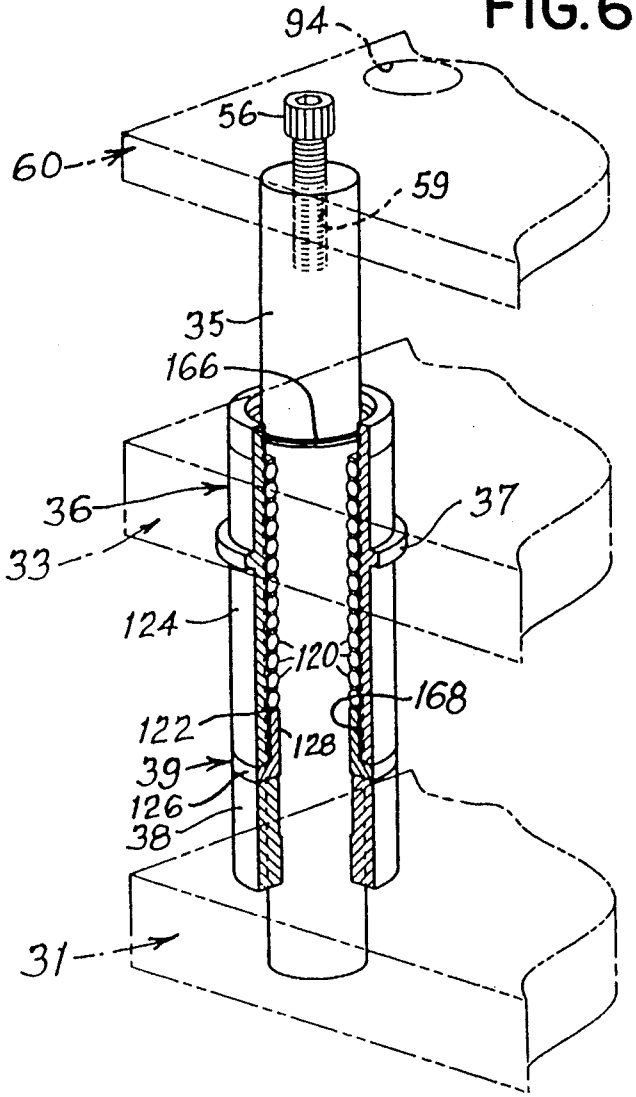
FIGS. 6A and 6B respectively show "open" and "shut" relationships of a linear bearing (ball-bearing bushing) with its adjustable anti-skid stop for preventing downward dislodgement of the ball-cage and ball bearings.
Figure 6A:
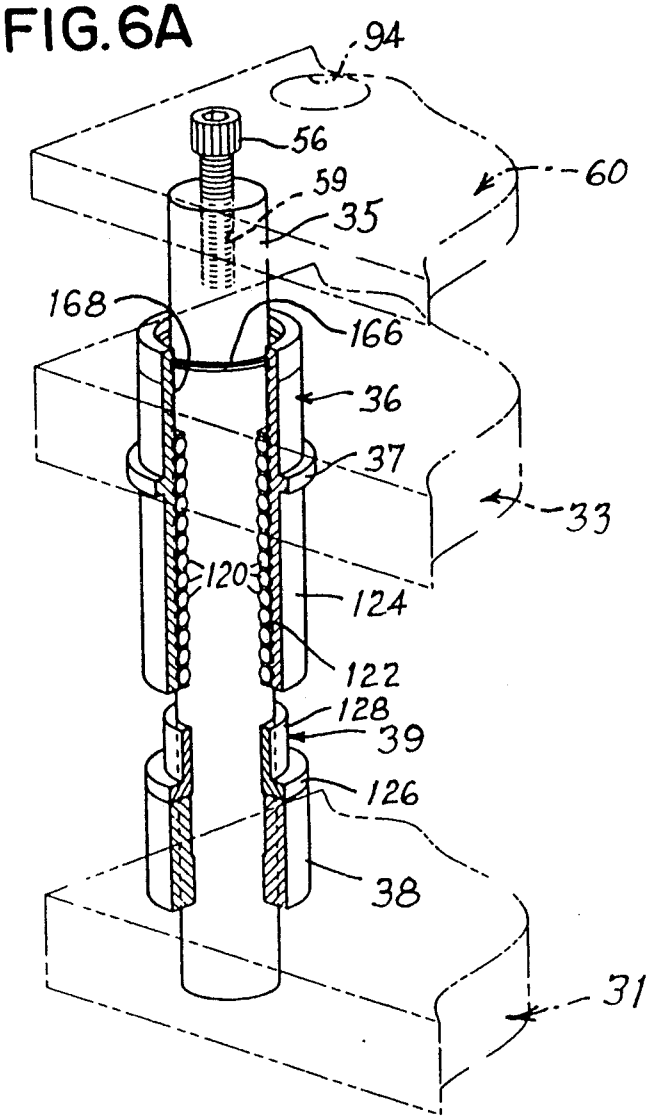

For preventing downward displacement of the ball-bearings and their cage (retainer) which are located within the housing of each bushing 36 (as shown in FIGS. 6A and 6B), there is a novel anti-skid stop 39 of smaller diameter than the main stop 38. Each anti-skid stop 39 extends upwardly coaxial with its associated main stop 38, and is positioned so that this anti-skid stop just "kisses" the bottom of the ball-bearing cage, as shown in FIG. 6B, when the die set has reached the limit of its down stroke, i.e. when the die set is fully "shut". Thus, the cage and balls are prevented from skidding down within the housing of the bushing 36, as will be explained in more detail later.

For driving the motion plate 33 downwardly with rapid acceleration and powerful force, the electromagnetic thrust motor 40 includes a movable armature 41 of ferromagnetic material rigidly connected to the motion plate 33 by a pair of vertical, parallel armature supports 42 of non-magnetic material, for example such as non-magnetic stainless steel, plastic material, ceramic material, or similar relatively rigid non-magnetic structural material, and in a preferred embodiment they are formed of non-magnetic stainless steel. In addition to FIG. 1, attention is now invited also to FIGS. 2, 3 and 4. Each armature support 42 has an axial downwardly projecting threaded stud 43 (FIGS. 3 and 4) of reduced diameter which is received in a threaded socket 44 in the motion plate 33. There is also an axial upwardly projecting stud 45 (FIG. 3) of reduced diameter which extends through a mounting passage 46 near an end of the armature 41.

Figures 5A, 5B, 5C:
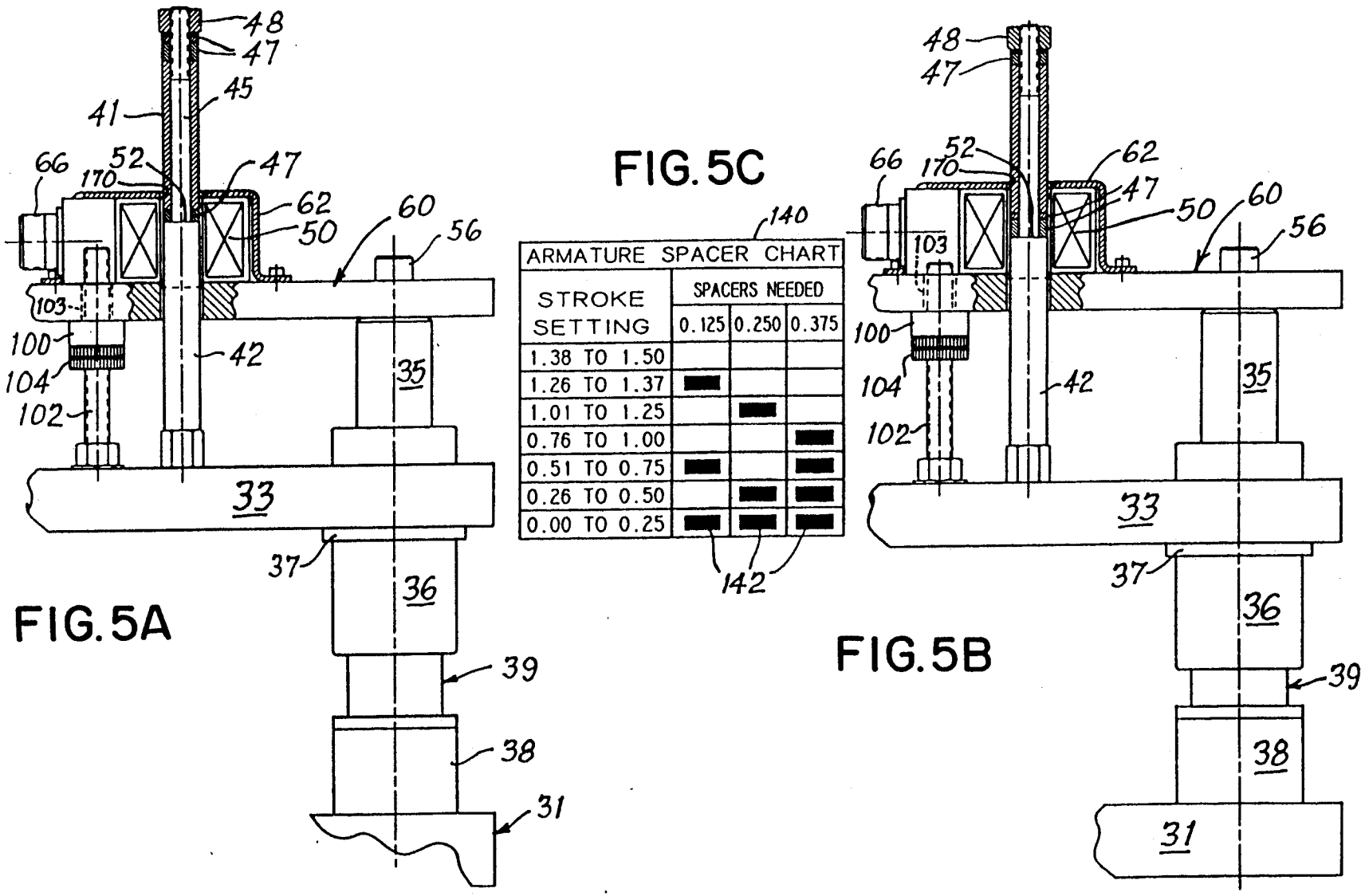
FIGS. 5A and 5B respectively show a longer and a shorter stroke adjustment for explaining operating advantages.
FIG. 5C is an armature spacer arrangement chart showing the method of obtaining stroke length adjustment.

In order to provide for quick and convenient adjustment of the armature elevation above the motion plate 33, i.e. for armature stroke adjustment, there are a plurality of washer-shaped armature spacers 47 (FIGS. 2 and 3) of non-magnetic, relatively rigid structural material such as discussed above for the armature supports 42, and in a preferred embodiment these spacers are formed of non-magnetic stainless steel having various thicknesses. These armature spacers are shown being stored on the upper end of the stud 45. The armature 41 and these spacers 47 are held by a locknut 48 with a washer 49. The nut is threaded onto the upper end of the stud 45. To increase the elevation of the armature 41 above the motion plate 33, the two nuts 48 are removed, the armature 41 is lifted off of its two mounting studs 45, and one or more of these non-magnetic spacers are moved down the stud 45, as shown in FIGS. 5A, B and C, to seat on an armature support shoulder 52 at the lower end of each stud 45. The armature 41 is then remounted on those spacers which have been placed on the shoulders 52 of the two supports 42. The remaining unused spacers 47 are again stored on the studs 45 below the respective locknuts 48.

The electromagnetic thrust motor 40 includes a solenoid winding (FIGS. 3 and 4) also called a "coil" having an opening 54 for accommodating the armature 41 and its two supports 42. This solenoid winding 50 is mounted on a stationary ferromagnetic top plate or deck 60 which is removably mounted on the upper ends of the four guide pins 35, being attached by removable cap screws 56 fitting through holes 58 (FIG. 2) engaging in threaded sockets 59 in the guide pins. A coil enclosure 62 of ferromagnetic material and serving as a magnetic flux director encloses the winding 50 and is secured to the ferromagnetic top plate 60 by screws 64. An electrical connector 66 (FIGS. 2 and 3) for the winding 50 is mounted on the rear of the coil enclosure. An electric power cable 68 (FIG. 1) attaches to this connector 66 for energizing the winding 50 with a pulse of power whenever the thrust motor 40 is operated.

Figure 4:
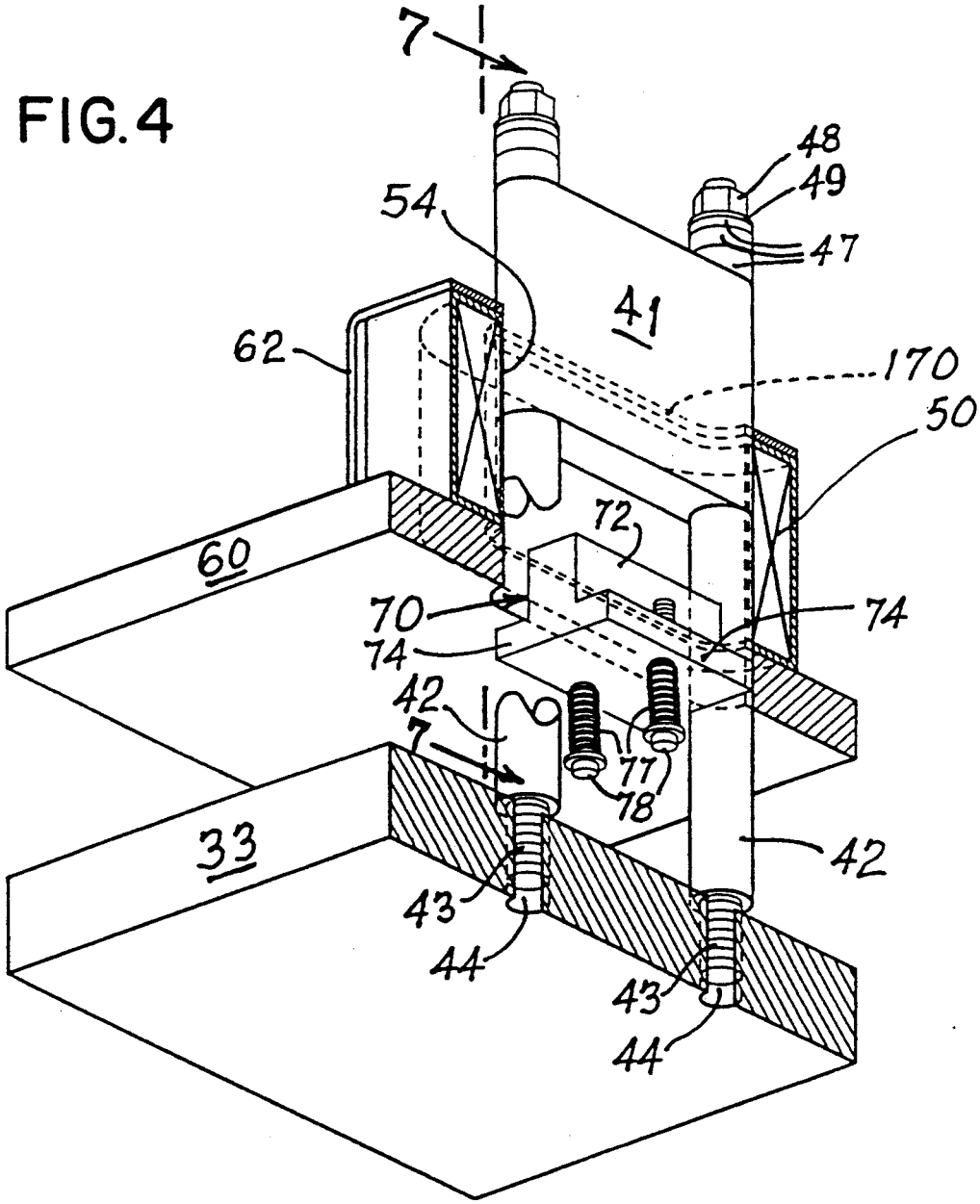
FIG. 4 is a partial perspective and sectional view as seen looking from below for showing a shuttle pole-piece having an inverted T-shape associated with the electromagnetic thrust motor.
Figure 7:
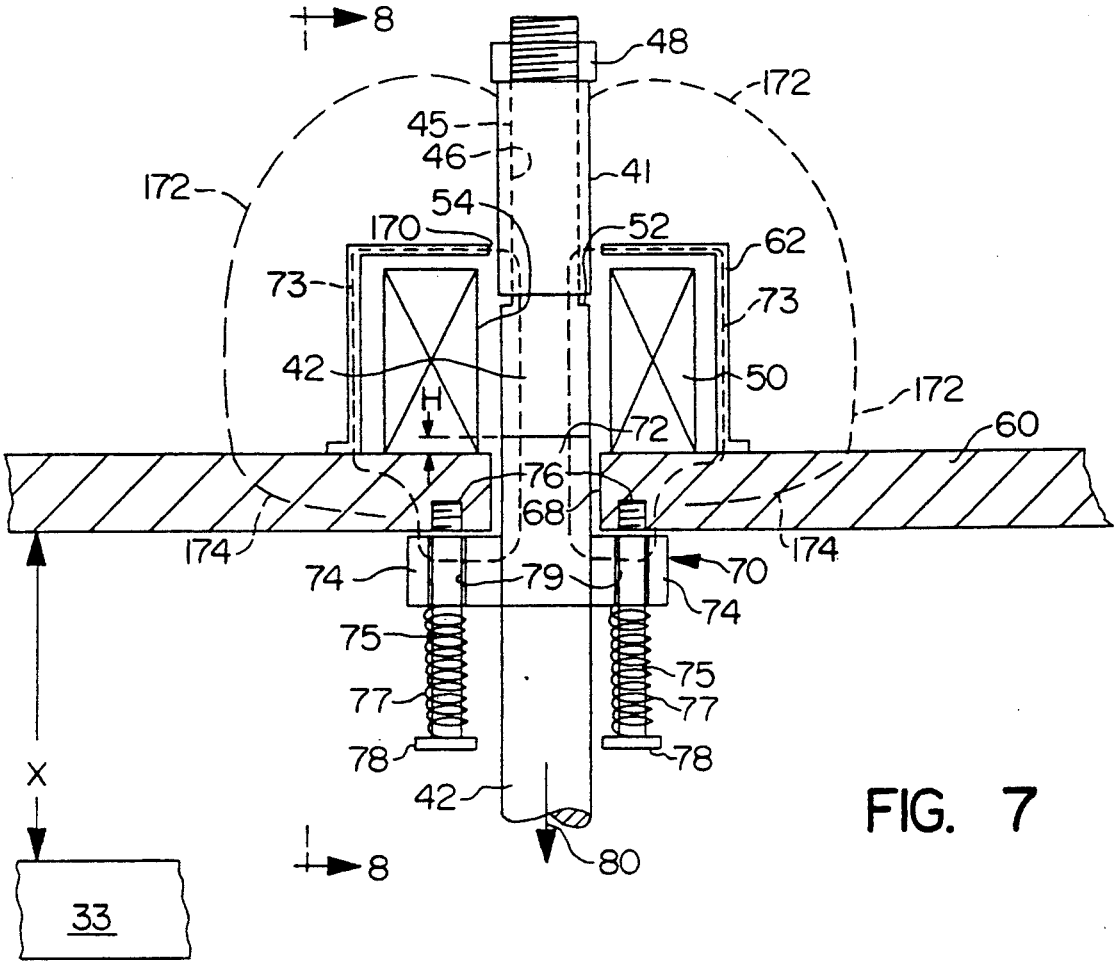
FIG. 7 is a partial elevational sectional view for illustrating features of the shuttle pole-piece and for showing isolation of the magnetic circuit and isolation of electromagnetic heating effects from the tooling.
Figure 8:
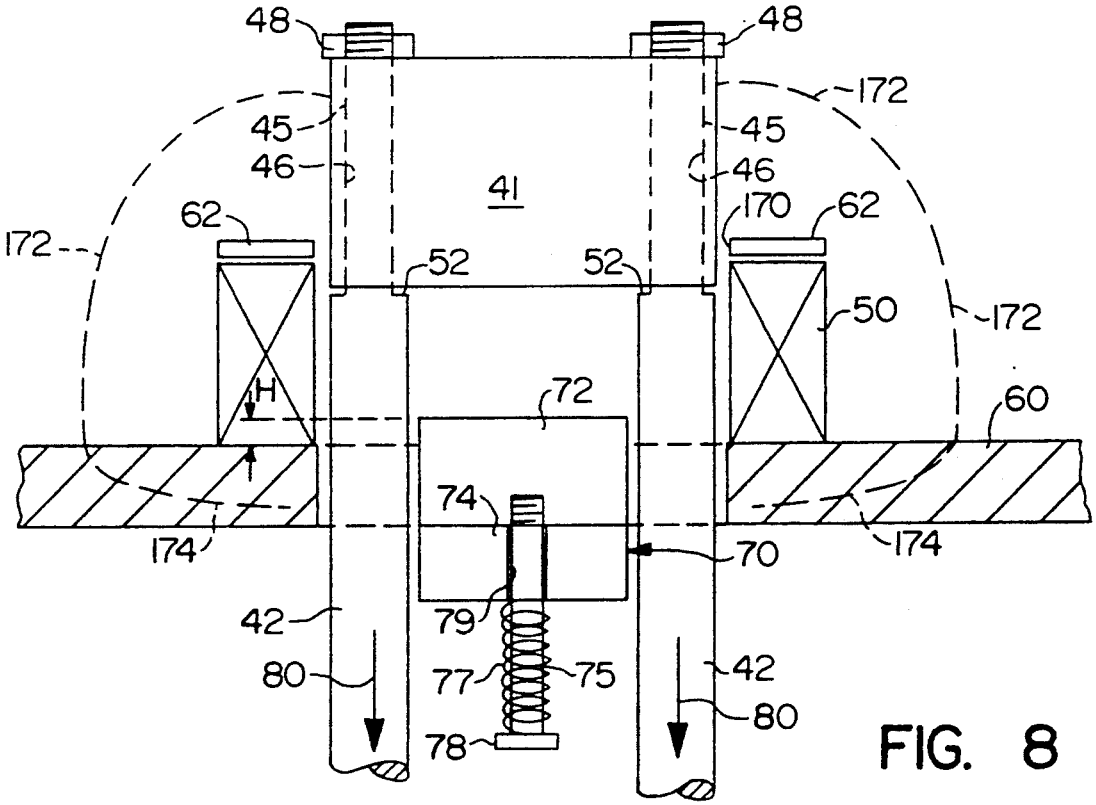
FIG. 8 is a partial elevational sectional view showing the same components as seen in FIG. 7.

With reference to FIGS. 4, 7 and 8, there is shown a shuttle pole-piece 70 of ferromagnetic material for increasing the efficiency and magnetic pull of the armature 41 into the coil 50. This shuttle pole-piece 70 has an inverted T-shape as seen in end elevation in FIG. 7 with a pole 72 which normally projects up into the winding opening 54 to a height "H" above the level of the upper surface of the top plate 60 and with a pair of side flanges 74 which normally rest up against the lower surface of the top plate 60. An opening 68 in this top plate is aligned with the winding opening 54 for accommodating the shuttle pole 72. This pole-piece 70 is vertically slidable along stationary slide rods 75 removably screwed into sockets 76 in the top plate 60. The pole-piece 70 is urged to its upper initial position as seen in FIGS. 7 and 8 by compression springs 77 seated on heads 78 of the vertical slide rods 75. The two parallel slide rods 75 on opposite sides of the pole-piece 70 extend through guide holes 79 in the centers of the respective side flanges 74.

In FIG. 7 the efficient flux paths which are provided by the ferromagnetic enclosure 62, ferromagnetic top plate 60 and ferromagnetic shuttle pole-piece 70 are shown by dashed lines 73. It is noted that these flux paths 73 are relatively far removed and isolated from the tooling. Moreover the armature supports 42 (push rods) are non-magnetic for enhancing the isolation from the tooling and for optimizing the downward thrust of the magnetic field 73 on the ferromagnetic armature 41.

In operation, when the solenoid winding 50 is briefly energized, the armature 41 is powerfully drawn down into the opening 54 until the bottom of the armature hits the pole 72 displacing the pole-piece 70 downwardly and momentarily compressing the springs 77. By virtue of the movable resilient mounting of this shuttle pole-piece 70 for allowing it to move down out of the way, any impact of the armature 41 against the opposed pole 72 is minimized for reducing noise, vibration and wear and tear of components involved and for minimizing tool "whip" that occurs in prior art electromagnetic punch presses when a movable armature impacts against a stationary fixed pole-piece. Such tool whip causes the dies to chatter sideways against each other resulting in unduly rapid rounding of cutting edges and divergent wearing of sidewalls immediately below or above the cutting edges in female and male dies, respectively.

The downward pull on the armature is transferred via the two armature supports (push rods) 42 as a powerful down thrust, indicated by arrows 80 in FIGS. 7 and 8, applied to the motion plate 33 for accelerating the tool die 34 (FIG. 1) downwardly to impact against work material W located between the moving and stationary tooling dies 34 and 32, respectively.

Figure 9:
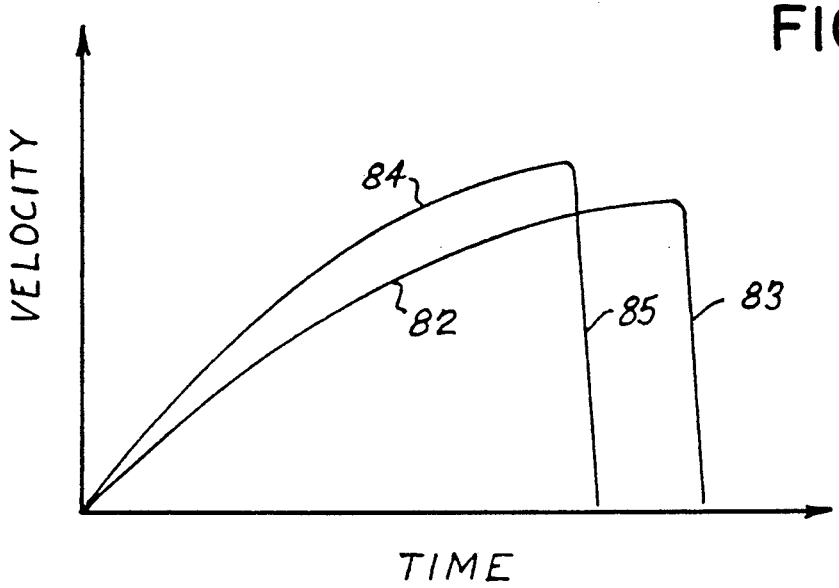
FIG. 9 is a plot of velocity versus time for showing the advantage of using a shuttle pole-piece illustrated in FIGS. 4, 7 and 8.

The advantage of using the shuttle pole-piece 70 is illustrated in FIG. 9. In the absence of this pole-piece, the downward velocity of the motion plate 33 as a function of time is a curve of the shape as generally shown at 82. The rapid drop in velocity at 83 occurs as the moving die 34 impacts against and penetrates through the work material W. Using the pole-piece 70 produces a more powerful pull on the armature causing more rapid acceleration of the motion plate, with consequent higher velocity producing a higher velocity curve of the shape as generally shown at 84, with rapid drop in velocity at 85 during performance of work. The higher velocity 84, as compared with 82, means that a more powerful and quicker tooling impact is provided, representing more efficient utilization of electric power during the work stroke and often producing a cleaner, neater shaping of the finished pieces F, because the higher rate of die closure gives less opportunity for flow of work material to occur while the dies are closing, i.e. gives less chance for distortion of the work material, and consequently there is less "spring back" in the finished pieces.

Upon completion of the work stroke, the housing of each ball-bearing bushing 36 (FIG. 2) is stopped by action of a stop 38 of tough, durable, resilient, rubbery material, for example polyurethane. The motion plate 33 is then returned to its initial upper position by a pair of return compression springs 90 each seated in a spring cup 92 (FIG. 2) mounted in a counterbored socket 94 in the top plate 60. There are a pair of spring support rods 96 secured to the motion plate 33, and one of these rods extends up through each return spring. For adjusting the spring force, the upper end of each rod 96 is threaded. A knurled return-rate adjusting locknut 98 with a washer is screwed downwardly along the rod for increasing compression of the spring to increase the return force and hence to increase the rate of the return stroke.

In order to stop the upward return stroke of the motion plate 33 and to adjust the stroke length, there are a pair of annular return stops 100 (FIGS. 2, 5A and 5B) of tough, durable, resilient rubbery material, for example polyurethane, each encircling a threaded stroke-adjusting post 102 secured to motion plate 33 and upstanding through a clearance hole 103. A knurled stroke-adjusting locknut 104 supports this return stop 100. As seen by comparing FIG. 5B with FIG. 5A the stroke-adjusting nut 104 is screwed to a higher position on its post 102 for reducing the stroke length by stopping the motion plate at a lower elevation, i.e. at a lower initial position relative to the base plate 31, i.e. at a smaller "open height".

Figures 2, 2A:
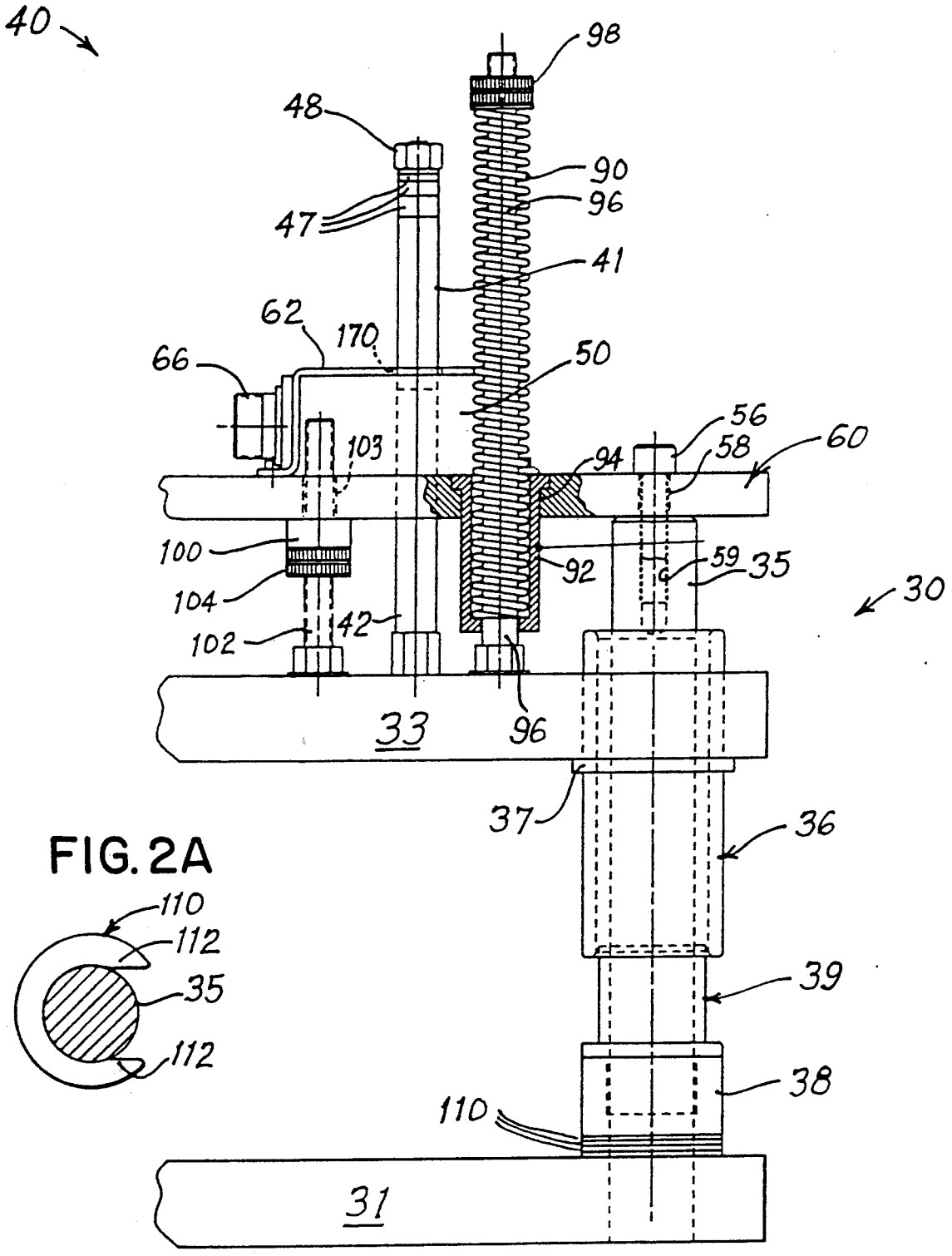
FIG. 2 is a side elevational view of the punch press of FIG. 1 as seen looking from the left in FIG. 1. The cover and cooling fan for the electromagnetic thrust motor have been removed in FIG. 2, and the rear portions of this punch press are broken away for clarity of illustration.
FIG. 2A is a plan view of a removable spacer associated with a guide pin shown in cross section and used for shut height adjustment.
Figure 3:
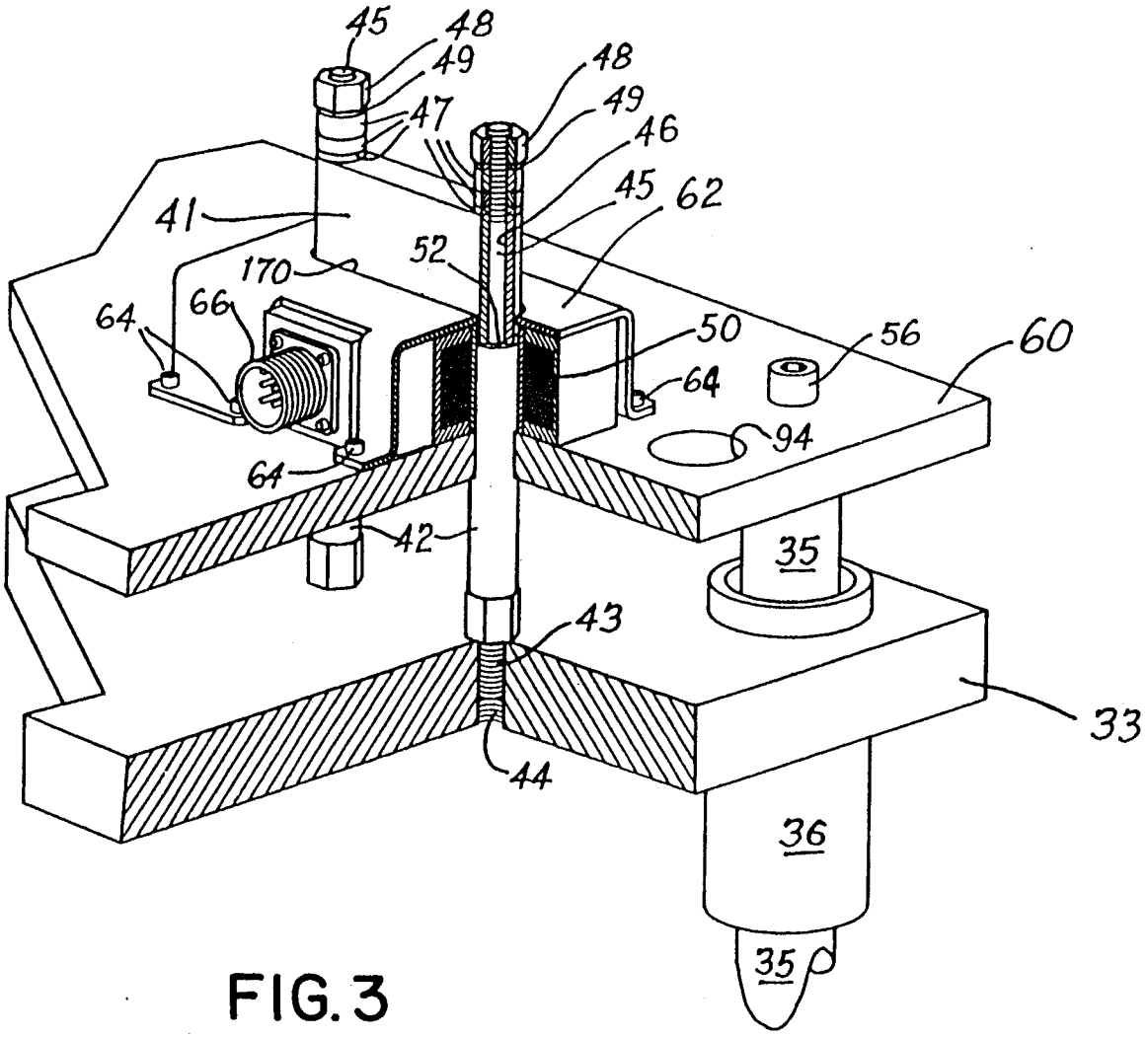
FIG. 3 is a partial perspective and sectional view as seen from above and looking at a rear electrical connector for showing the electromagnetic thrust motor mounted on a stationary top plate and having its armature connected by non-magnetic armature supports to a motion plate.

As shown in FIGS. 2 and 6A, the "open height" of the die set 30, i.e. the initial spacing between the moving and base plates 33 and 31, respectively, is determined by the initial position of the motion plate 33 relative to the base plate 31, and this open height is established by the adjusted position of the return stop 100 (FIGS. 2, 5A and 5B).

For balancing the return spring forces with the return stop actions, the return spring 90 on the left in FIG. 1 is located in front of its associated return stop 100, while the return spring at the right is located behind its associated stop, thereby providing a balanced relationship relative to the motion plate 33 and top plate 60. Moreover, the vertical centerlines of these four components left spring, left stop and right spring, right stop symmetrically straddle the vertical centerline of the armature 41 with both front-to-rear symmetry and also left-to-right symmetry.

The "shut height" of the die set 30, i.e. the final vertical spacing between the moving and base plates 33 and 31, respectively, as shown in FIG. 6B, is determined by the elevation of the top of the stops 38 above the base plate. For providing convenient adjustment of this shut height, there are a plurality of removable spacers 110 (FIG. 2), for example having thicknesses in the range of about 0.030 of an inch (about 0.75 mm) to about 0.010 of an inch (about 0.25 mm). This shut height matches the required fully closed position of the die tooling 32, 34. When the dies have become worn through normal use, their cutting edges become slightly rounded and diverging. The dies are sharpened by horizontal grinding of their opposed surfaces, thereby creating new, sharp cutting edges. This sharpening slightly reduces the overall height of the two dies. In order to compensate for this reduced die height, the die set shut height is correspondingly reduced by removing one or more of the spacers 110 from beneath the stops 38.

In order to facilitate removal of one or more of the spacers 110 for reducing shut height, these spacers 110 have a C-shape (FIG. 2A) wherein the two legs 112 are sufficiently close together at their tips for preventing accidental dislodgement of a spacer from a guide pin 35, but a spacer can be easily intentionally pulled off with pliers or wedged off with a screw driver.

Attention is now invited to FIGS. 6A and 6B for explaining operation of the anti-skid stops 39. The ball-bearing bushings 36 include multiple ball bearings 120 captured in a cage 122 (also called a "retainer"). When the motion plate 33 is in its initial open height position, as shown in FIG. 6A, the balls 120 and 122 are normally located near the lower end of the housing 124 of each bushing 36. As the motion plate moves down to the lower end of its stroke, the balls 120 roll downwardly along the guide pin 35 while they are also simultaneously rolling upwardly along the inside surface of the downwardly moving bearing housing 124. The net effect of this rolling action of the balls 120 is that the bearing housing 124 travels downwardly twice as fast and twice as far as the balls 120 and their cage 122. Consequently, when the bearing 36 reaches the limit of its down (work) stroke at the shut height, as shown in FIG. 6B, the balls and cage are now located near the top of the bearing housing 124.

In the prior art, the stopping of a bearing housing such as 124 against a stop often caused the balls and their cage to skid down inside of the bearing housing due to their downward momentum. Consequently, the balls would become improperly positioned for the return stroke, and they would skid up along the guide pin 35 during the return stroke due to the conventional retainer in the lower end of the bearing housing, causing undue wear and deterioration of the involved parts.

The anti-skid retainer stop 39 includes an annular flange shoulder 126 resting on the resilient stop 38 and an upstanding cylindrical anti-skid sleeve member 128 of sufficiently small diameter and appropriate radial thickness for projecting up into the bearing housing 124 for "kissing" the lower end of the cage 122 at the shut height position. This anti-skid sleeve 128 prevents any downward skidding of the cage and balls 122, 120; so that they are appropriately positioned for providing the desired, intended anti-friction free rolling during each return stroke.

Figure 10:
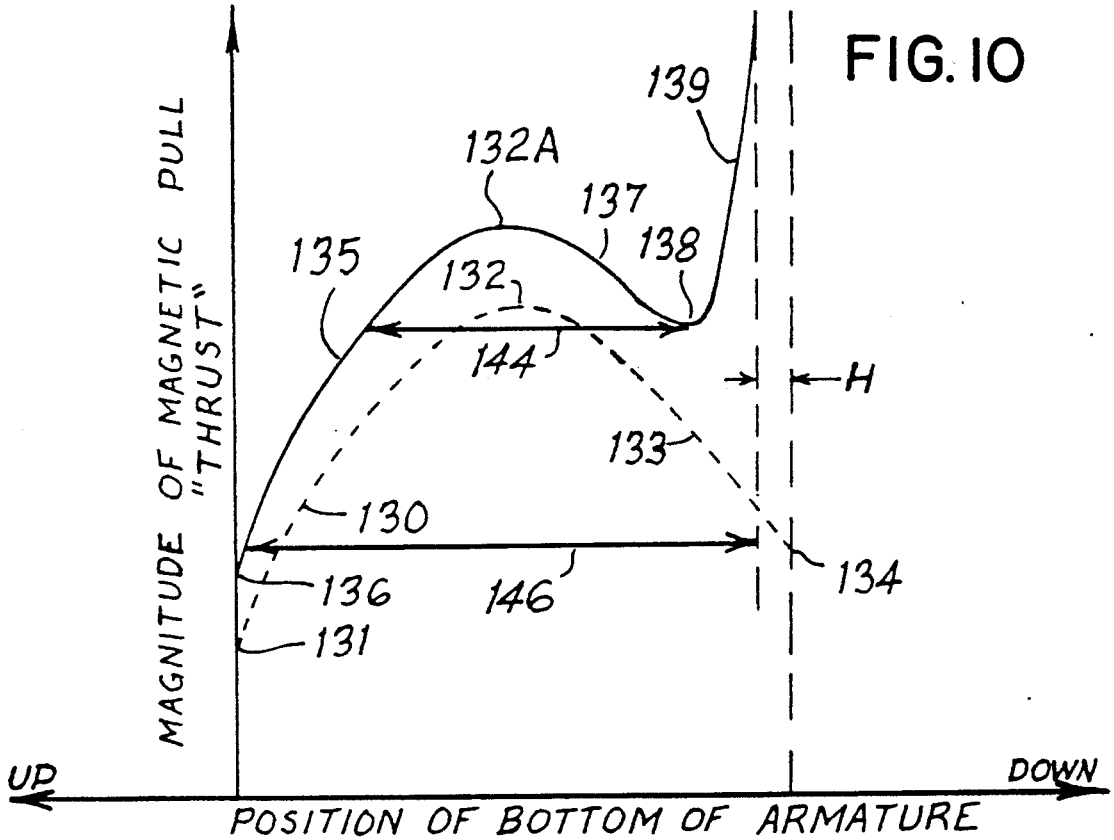
FIG. 10 is a plot of magnetic thrust force shown as a function of armature position relative to the solenoid winding.
Figure 10:
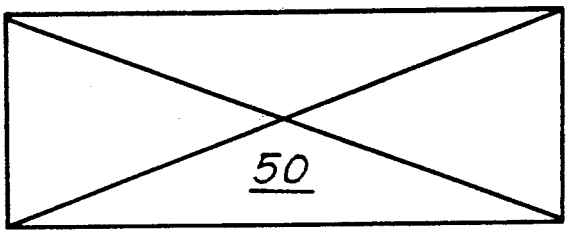

In FIG. 10 is shown a plot 130 of the magnetic pull (force or thrust) on the armature as a function of the position of the bottom (lower end) of the armature relative to the solenoid winding. The downward thrust is at a minimum at 131 when the lower end of the armature is at the upper end of the solenoid winding. As the armature moves down, the magnitude of the downward thrust 130 (dashed curve) increases, reaching a maximum thrust value near a mid-point 132 on curve 130 when the lower end of the armature is half-way into the winding. Thereafter, the downward thrust decreases along the dashed curve in region 133 as the armature continues to move down. The dashed curve 130, 133 indicates the pattern of thrust which occurs in the absence of the shuttle pole-piece 70 (FIGS. 4, 7 and 8). This dashed curve reaches another minimum at 134.

The armature in this embodiment is longer in the stroke direction than the axial length of the winding, and thus there is significant pull at 13 because the armature is still being pulled down toward a symmetrical position relative to the winding.

In the presence of the pole-piece 70, which extends a distance "H" into the winding opening, the solid-line curve 135 indicates the pull pattern. A somewhat higher initial pull 136 occurs and a higher mid-point maximum thrust 132A near mid-point is provided. The thrust pattern 137 then decreases somewhat until the lower end of the armature is relatively close at 138 to the pole-piece 70, being another minimum, whereupon the attraction between the lower end of the armature and the pole 72 increase dramatically at 139 during the final closure between them.

The considerably larger area under the solid-line curve 135, 137, 139 as compared with the area under the dashed curve 130, 133 indicates the additional amount of energy (additional amount of available capability for performing foot-pounds of work) which is provided by installing the shuttle pole-piece 70.

The value of H (FIGS. 7 and 8) for the shuttle pole-piece is advantageously in the preferred range of about 1/16th to about 5/16ths of an inch. In this preferred embodiment, H has a value of about ⅛th to 3/16ths of an inch.

When the work material and tooling 32, 34 require a relatively short work stroke, as shown by a double-headed arrow 144, it is desirable to have this short work stroke 144 generally symmetrically positioned relative to the central maximum 132A for maximizing the integrated energy (area under the curve) available from the magnetic thrust curve 135, 132A, 137 for most effectively accelerating the motion plate 33. When a longer work stroke is required, as shown by a double-headed arrow 146, it is still desirable to have this longer work stroke 146 be located generally symmetrically positioned relative to the central maximum 132A, because the mass of the motion plate 33 and associated moving components need to be accelerated for accumulating kinetic energy. The brief large thrust 139 occurs over such a short portion of the stroke length that it does not have much opportunity to produce much tool acceleration in and of itself, but the presence of this shuttle pole-piece 70 does significantly increase the magnitude of the magnetic pull 135-137-139 available throughout the whole stroke, thus resulting in the higher velocity curve 84 in FIG. 9. About 20% of additional work capability is provided by installing such a shuttle pole-piece. The broad-rounded shape of the thrust curve 135, 137 near its maximum 132A has a relatively longer time in which to integrate its accelerating effect into a relatively higher tool velocity and higher kinetic energy prior to impact.

In this preferred embodiment, the axial length of the winding opening 54 is about 1.75 inches. The armature length in the stroke direction is about 3.0 inches. Thus, in this embodiment the armature length in the stroke direction is about 170% of the axial length of the winding opening. Increasing this armature length above a relative length of about 215% does not significantly further increase the available energy (area under the solid-line curve 135, 137, 139). Conversely, decreasing this armature length below about 140% of the axial length of the winding does significantly decrease the available energy. In summary, the preferred relative length of the armature is in the range from about 140% to about 215%, a more preferred relative length is in the range of bout 150% to about 200% and an optimum is in the range of about 160% to about 190%.

The impact force "IF" which is available for doing work of the tooling against the work material is expressed by:

$$IF = \text{Magnetic Thrust} + \tfrac{1}{2}(MV^2)/d \qquad (1)$$

"M" is the total effective mass of the moving components exerted on the male die 34; "V" is the velocity of this effective mass; and "d" is the stopping distance. It will be appreciated that the "$MV^2$" term is of far larger magnitude than the Magnetic Thrust in providing impact force, because $MV^2$ represents the accumulated (integrated acceleration) effect of the magnetic thrust applied to mass M over the whole stroke length for producing velocity V prior to the moment of impact.

The energy "E" available to provide useful work in forming the finished pieces F is expressed by:

$$E = Td + \tfrac{1}{2}MV^2 \qquad (2)$$

"T" is the magnetic thrust, and "d" is the stopping distance. At least most of this stopping distance involves working of the material. It is assumed that the value of T remains relatively constant over the stopping distance d, which is a relatively short distance. Again, it will be appreciated that the second term of this energy equation (2) involves the square of velocity V and is by far the dominant factor and consequently every effort is desirable toward maximizing velocity V prior to the instant of impact.

For optimizing the relationship of armature thrust relative to stroke length, the elevation of the armature 41 above the motion plate 33 is adjusted by the spacers 47 already described stored on the upper end of the upper studs 45 of the armature supports 42. These spacers are used to adjust the effective length of the armature supports (thrust rods) 42, as will now be further explained with reference to FIGS. 5A, B and C. For example, there are three spacers 47 having the respective thicknesses 0.125, 0.250 and 0.375 of an inch (3.18, 6.35 and 9.53 mm). For example, the armature spacer chart 140 in FIG. 5C is shown to cover a range of adjustable stroke length settings from 1.50 inches (38.1 mm) to zero using three such spacers 47. The words "SPACERS NEEDED" indicates the utilization of spacers placed below the armature 41 on the shoulder 52 at the lower end of the stud 45 for effectively lengthening the armature supports (push rods) 42. For the longest stroke setting, in the range from 1.38 to 1.50 of an inch, none of the spacers are placed on the shoulder 52 at the bottom of the stud 45 below the armature 41. For the shortest stroke setting, in the range from 0.00 to 0.25 of an inch, all three of the spacers 47 are placed on the shoulder 52 below the armature, as indicated by three rectangular marks 142. For intermediate stroke length settings, as shown in the chart 140, various combinations of these three spacers 47 are used for optimizing armature thrust relative to stroke length.

In order to reduce the stroke length, as explained previously in detail, the return stop 100 is positioned higher on its adjustment post 102 by turning up the stroke-length adjusting lockout 104, and vice versa.

For quick and convenient change-over between die sets for providing different production runs, the motor 40 is removed and transferred to another die set 30 having a different tooling set up. To accomplish such interchanging of the motor, the housing 21 (FIG. 1) is temporarily removed; the cap screws 56 and spring return-rate adjusting nuts 98 are removed. Then the top (deck) plate 60 is moved to the next die set together with the springs 90, spring cups 92, solenoid winding 50 and its enclosure 62 and with the motor housing 21 and cooling fan 23. The armature 41 remains attached to the motion plate 33 for retaining its adjustment, and similarly the return stop 100 remains for retaining its adjustment in readiness for subsequent use of the die set 30, without incurring loss of time and machinist's expense for tooling set-up.

Inviting attention back to FIGS. 6A and 6B, it is noted that the ball-bearing bushings 36 include a retaining ring 166 located within the bearing housing 124 near its upper end. This retaining ring 166 protrudes into the bore 168 of the bearing housing 124 for providing an annular shoulder projecting radially into the bore for retaining the cage 122 and balls 120 within the bore 168 to prevent them from accidentally coming out of an end of the bearing housing. Normally, there is also a similar retaining ring in the bore 168 at the lower end of the bearing housing. These ball-bearing bushings 36 are specially configured to omit a second retaining ring in accord with the present invention. In order to provide clearance for entry of the anti-skid sleeve element 128 into the bore 168, as shown in FIG. 6B, there is no retaining ring at the lower end of the ball-bearing bushing. The anti-skid element 128 prevents downward skidding of balls 120 and cage 122. Consequently, in FIG. 6B, the balls and cage are kept at a high position relative to the bearing housing 124, and therefore they do not come out of the lower end of the bore 168 when they are at a low position relative to the bearing housing in FIG. 6A.

With further reference to FIGS. 1, 3, 4, 5A, 5B, 7 and 8, it is noted that the winding enclosure flux director 62 has an passageway 170 at the top of the solenoid winding 50. This enclosure opening 170 is aligned with the winding opening 54, and the edges of this opening 170 serve as an upper pole-piece positioned close to the side surfaces of the armature 41 and serving to direct magnetic flux 73 (FIG. 7) into the armature. Also, please note in FIGS. 7 and 8 that the large area of the ferromagnetic top mounting plate 60 very effectively serves to capture stray ("leakage") magnetic flux. Such stray flux is outside of the ferromagnetic enclosure 62 and couples to the armature 41 above the opening 170 in this enclosure, as shown by the dashed lines 172. This ferromagnetic top mounting plate 60 in capturing such stray flux thereby greatly minimizes the existence of any stray flux below this mounting plate 60. The stray flux 172 which couples to this ferromagnetic plate 60 is directed inwardly at 174 toward the shuttle pole-piece 70 instead of looping down and causing magnetization of the tooling 34, 32 or the guide pins 35 or bushings 36. As shown in FIG. 7, this ferromagnetic top mounting member 60 is positioned a distance "X" of at least about two inches (at least about 50 mm) above the initial position of motion member 33 for establishing this distance of air space for providing the large reluctance of such air space below the ferromagnetic top plate for further isolating the tooling from magnetization.

Thus, the ferromagnetic top mounting plate member 60, ferromagnetic enclosure 62 and ferromagnetic shuttle pole-piece 70 in cooperation with the elevation of the top plate above the motion plate 33 and the non-magnetic push rods 42 advantageously serve to isolate substantially the magnetic and heating effects of the winding from the upper and base tooling 34 and 32. The airflow from the cooling fan carries away heat by outflow of air through the side outlet ports 25 located above the top plate and further serving to isolate heating effects from the tooling.

For convenience of describing the electromagnetic punch press embodiments of this invention in a readily understood manner with reference to the accompanying drawings, it is noted that various punch press components are shown and described as being oriented vertically in upstanding relationship relative to the horizon, such that the work stroke involves a downward motion and the subsequent return stroke involves an upward motion, because such a vertical orientation is the usual or normal orientation of a punch press when installed in a manufacturing plant. However, it is to be understood that the electromagnetic punch press embodiments of this invention are capable of operating when oriented at any desired orientation relative to the horizon. Therefore, words such as "upstanding", "vertical", "vertically", "down", "downward", "downwardly", "up", "upwardly", "upper", "lower", "above", "horizontal", "top", "bottom", and the like, are not intended to be limiting but rather are intended to be interpreted as describing the various punch press components in the particular orientation in which they are herein illustrated, with the clear understanding that such electromagnetically driven punch presses can be oriented and operated vertically or horizontally or at any desired slanted orientation between vertical and horizontal as may be required or desired due to circumstances occurring at a particular installation or utilization site.

Since other changes and modifications varied to fit particular operating requirements and environments will become recognized by those skilled in the art, the invention is not considered limited to the examples chosen for purposes of illustration of presently preferred embodiments and includes all changes and modifications which do not constitute a departure from the true spirit and scope of this invention as claimed in the following claims and equivalents of the claimed elements.

I claim:

1. For use in a punch press including a base for mounting base tooling and having a plurality of guide pins upstanding from the base in spaced relationship with a motion member above the base for mounting upper tooling above the base tooling, said motion member being carried by ball-bearing bushings mounted to the motion member, said ball-bearing bushings each including a housing having multiple balls rollable within the housing and held by a cage within the housing, said balls being rollable downwardly along a respective guide pin during a downward stroke of said motion member and upwardly along the respective guide pin during an upward return stroke of said motion member, and wherein said motion member suddenly stops at a lower limit of the downward stroke, apparatus comprising:

a plurality of anti-skid stops, respective anti-skid stops being adapted to be associated with respective guide pins near the lower limit of the down stroke, each anti-skid stop having an anti-skid element for positioning near an associated guide pin, said anti-skid element is adapted to enter into a lower end of the housing of the ball-bearing bushing near the lower limit of the down stroke for preventing the cage and the balls held by the cage from skidding downwardly within the bearing housing when the motion member suddenly stops at the lower limit of the down stroke, and the lower end of the housing of the ball-bearing bushing has clearance for allowing entry of said anti-skid element into the lower end of the housing.

2. For use in a punch press including a base for mounting base tooling and having a plurality of guide pins upstanding from the base in spaced relationship with a motion member above the base for mounting upper tooling above the base tooling, said motion member being carried by ball-bearing bushings mounted to the motion member, said ball-bearing bushings each including a housing having multiple balls rollable within the housing and held by a cage within the housing, said balls being rollable downwardly along a respective guide pin during a downward stroke of said motion member and upwardly along the respective guide pin during an upward return stroke of said motion member, and wherein said motion member suddenly stops at a lower limit of the downward stroke, apparatus comprising:

a plurality of anti-skid stops, respective anti-skid stops being adapted to be associated with respective guide pins near the lower limit of the down stroke, each anti-skid stop having an anti-skid element for positioning near an associated guide pin, said anti-skid element is adapted to enter into a lower end of the housing of the ball-bearing bushing near the lower limit of the down stroke for preventing the cage and the balls held by the cage from skidding downwardly within the bearing housing when the motion member suddenly stops at the lower limit of the down stroke, the lower end of the housing of the ball-bearing bushing has clearance for allowing entry of said anti-skid element into the lower end of the housing, and said anti-skid element is a sleeve for encircling the guide pin near the lower limit of the down stroke.

3. For use in a punch press including a base for mounting base tooling and having a plurality of guide pins upstanding from the base in spaced relationship with a motion member above the base for mounting upper tooling above the base tooling, said motion member being carried by ball-bearing bushings mounted to the motion member, said ball-bearing bushings each including a housing having multiple balls rollable within the housing and held by a cage within the housing, said balls being rollable downwardly along a respective guide pin during a downward stroke of said motion member and upwardly along the respective guide pin during an upward return stroke of said motion member, and wherein said motion member suddenly stops at a lower limit of the downward stroke, apparatus comprising:

a plurality of anti-skid stops, respective anti-skid stops being adapted to be associated with respective guide pins near the lower limit of the down stroke, each anti-skid stop having an anti-skid element for positioning near an associated guide pin, said anti-skid element is adapted to enter into a lower end of the housing of the ball-bearing bushing near the lower limit of the down stroke for preventing the cage and the balls held by the cage from skidding downwardly within the bearing housing when the motion member suddenly stops at the lower limit of the down stroke, the anti-skid stop is adapted for encircling the guide pin near the lower limit of the down stroke, the anti-skid stop includes an annular shoulder projecting radially outwardly, and said annular shoulder is adapted to seat upon resilient stop means in a position for the lower end of the bearing housing to come into contact with said annular shoulder at the lower limit of the down stroke.

4. For use in a punch press, the apparatus claimed in claim 3, in which:

said anti-skid stop includes an upstanding sleeve adapted for closely encircling the guide pin, said annular shoulder projects radially outwardly from a lower portion of said upstanding sleeve, and said upstanding sleeve enters the lower end of the ball-bearing bushing and comes into contact with the cage in the bushing for preventing the cage and the balls held by the cage from skidding downwardly at the lower limit of the down stroke.

5. For use in a punch press, the apparatus claimed in claim 4, further comprising:

stroke adjustment means for adjusting the lower limit of the down stroke by adjusting a position of said resilient stop means relative to said base, whereby adjustment of said lower limit does not change the relationship between said annular shoulder and said anti-skid element.

6. For use in a punch press, the apparatus claimed in claim 5, in which:

said stoke adjustment means comprises adjustable spacer means between said resilient stop means and said base.

7. For use in a punch press, the apparatus claimed in claim 6, in which:

said adjustable spacer means comprise a plurality of removable C-shaped spacers for removably encircling the guide pin positionable between said base and said resilient stop means.

8. For use in a punch press, the apparatus claimed in claim 3, further comprising:

adjustment means for adjusting the lower limit of the down stroke by adjusting a position of said resilient stop means relative to said base, whereby adjustment of said lower limit does not change the relationship between said annular shoulder and said anti-skid element.

9. For use in a punch press, the apparatus claimed in claim 8, in which:

said stroke adjustment means comprises adjustable spacer means between said resilient stop means and said base.

10. For use in a punch press, the apparatus claimed in claim 9, in which:

said adjustable spacer means comprise a plurality of removable C-shaped spacers for removably encircling the guide pin positionable between said base and said resilient stop means.

11. In a punch press having first tooling mounted on first mounting means and second tooling mounted on second mounting means and having a plurality of guide pins for guiding said first and second mounting means toward and away from each other during a work stroke and during a return stroke, respectively, and wherein a plurality of ball-bearing bushings are used rolling along respective guide pins, said ball-bearing bushings each including a housing having multiple balls rollable within the housing and retained by a cage within the housing, apparatus comprising:

a plurality of anti-skid means, respective anti-skid means being associated with respective guide pins near a lower limit of the work stroke, each anti-skid means having an anti-skid element near the associated guide pin, said anti-skid element entering into an end of the housing of the ball-bearing bushing rolling along the associated guide pin near the limit of the work stroke and controlling the cage for preventing the cage and the balls from becoming displaced within the housing when motion of the bushing suddenly stops at the limit of the work stroke, and said end of the housing of the ball-bearing bushing having clearance for allowing entry of said anti-skid element into said end of the housing and for allowing said anti-skid element to come into contact with an end of the cage for controlling the cage.

12. In a punch press having first tooling mounted on first mounting means and second tooling mounted on second mounting means and having a plurality of guide pins for guiding said first and second mounting means toward and away from each other during a work stroke and during a return stroke, respectively, and wherein a plurality of ball-bearing bushings are used rolling along respective guide pins, said ball-bearing bushings each including a housing having multiple balls rollable within the housing and retained by a cage within the housing, apparatus comprising:

a plurality of anti-skid means, respective anti-skid means being associated with respective guide pins near a lower limit of the work stroke, each anti-skid means having an anti-skid element near the associated guide pin, said anti-skid element entering into an end of the housing of the ball-bearing bushing rolling along the associated guide pin near the limit of the work stroke for preventing the cage and the balls from becoming displaced within the housing when motion of the bushing suddenly stops at the limit of the work stroke, said end of the housing of the ball-bearing bushing has clearance for entry of said anti-skid element into said end of the housing, and said anti-skid element is an anti-skid sleeve encircling the associated guide pin near said limit of the work stroke.

13. In a punch press having first tooling mounted on first mounting means and second tooling mounted on second said first and second mounting means toward and away from each other during a work stroke and during a return stroke, respectively, and wherein a plurality of ball-bearing bushings are used rolling along respective guide pins, said ball-bearing bushings each including a housing having multiple balls rollable within the housing and retained by a cage within the housing, apparatus comprising:

a plurality of anti-skid means, respective anti-skid means being associated with respective guide pins near a limit of the work stroke, each anti-skid means having an anti-skid element near the associated guide pin, said anti-skid element entering into an end of the housing of the ball-bearing bushing rolling along the associated guide pin near the limit of the work stroke for preventing the cage and the balls from becoming displaced within the housing when motion of the bushing suddenly stops at the limit of the work stroke, said anti-skid means encircles the guide pin near the limit of the work stroke, said anti-skid means include an annular shoulder projecting radially outwardly, said annular shoulder seats upon resilient stop means in a position for the end of the bearing housing to come into contact with said annular shoulder at said limit of the work stroke; and said anti-skid element is connected to said annular shoulder and extends from said annular shoulder toward said ball-bearing bushing.

14. Apparatus as claimed in claim 13, in which:

adjustment means adjust said limit of the work stroke, and said adjustment means equally adjusts positions of said anti-skid element and of said annular shoulder, whereby adjustment of said limit of the work stroke does not change the relationship between said annular shoulder and said anti-skid element.

15. In a punch press having a first tool mounted on a first member and a second tool mounted on a second member and having a plurality of guide pins for guiding said first and second members relatively toward each other during a work stroke for punching material between the first and second tools, said guide pins guiding said first and second members away from each other during a return stroke and having a plurality of ball-bearing bushings rolling along respective guide pins in a first direction during said work stroke and rolling along respective guide pins in a second direction during said return stroke, each of said ball-bearing bushings including a housing having multiple balls rollable within the housing and being retained by a cage within the housing, apparatus comprising:

a plurality of resilient means for cushioning sudden stopping of relative motion of said first and second members toward each other at a limit of said work stroke, a plurality of anti-skid stops, each of said anti-skid stops encircling a respective guide pin, each anti-skid stop being associated with respective resilient means, each anti-skid stop including a sleeve closely encircling a respective guide pin and being of sufficiently small external diameter for entering into an end of the housing of the ball-bearing bushing rolling along a respective guide pin as said first and second members are nearing said limit of said work stroke, each anti-skid stop including a stop shoulder of larger diameter than said sleeve, said stop shoulder being near the associated resilient means, said end of the housing coming into contact with said stop shoulder at the limit of the work stroke, and said anti-skid stop including a sleeve closely encircling a respective guide pin and being of sufficiently small external diameter for entering into an end of the housing of the ball-bearing bushing rolling along a respective guide pin as said first and second members are nearing said limit of said work stroke, each anti-skid stop including a stop shoulder of larger diameter than said sleeve, said stop shoulder being near the associated resilient means, said end of the housing coming into contact with said stop shoulder at the limit of the work stroke, and said sleeve coming into contact with the cage in said housing at the limit of the work stroke for preventing skidding in said first direction of the cage and the balls within said housing.

16. Apparatus claimed in claim 15, in which:

shut height adjustment means for adjusting the limit of said work stroke serve to adjust positioning of said resilient means relative to one of said members.

17. Apparatus claimed in claim 16, in which:

said shut height adjustment means comprises adjustable spacer means positioned between the resilient means and said one member.

18. Apparatus claimed in claim 17, in which:

said adjustable spacer means comprise a plurality of thin C-shaped spacers removably encircling the guide pin between the resilient means and said one member.

19. In an electromagnetic thrust motor for use in a punch press, said motor having a solenoid winding with an opening upon electrical energization of the winding and a push rod connected from said armature to a movable part of the punch press for moving said part of the punch press, adjustment means for adjusting the position of the armature comprising:

a shoulder on the push rod, a stud on the push rod upstanding above said shoulder, said armature having a mounting passage therein, said stud upstanding through said mounting passage for mounting the armature on said stud above said shoulder, releasable fastening means on said stud for retaining the armature on the stud, a plurality of non-magnetic spacers each having a hole therein, said spacers having various thicknesses, said holes being of sufficient size for allowing said spacers to be mounted on said stud and being sufficiently small for preventing any spacers on the stud and located below the armature from going downward past said shoulder, and said spacers being mounted on said stud along with the armature.

* * * * *